US008702186B2

(12) United States Patent
Snyder et al.

(10) Patent No.: US 8,702,186 B2
(45) Date of Patent: Apr. 22, 2014

(54) METHOD AND APPARATUS FOR INK RECIRCULATION

(75) Inventors: Trevor James Snyder, Newberg, OR (US); Nicholas C. Hill, Portland, OR (US); Devin Kyle Byerley, Keizer, OR (US); Rodney Bryant Hill, Mt. Angel, OR (US); Steven Van Cleve Korol, Dundee, OR (US)

(73) Assignee: Xerox Corporation, Norwalk, CT (US)

( * ) Notice: Subject to any disclaimer, the term of this patent is extended or adjusted under 35 U.S.C. 154(b) by 139 days.

(21) Appl. No.: 13/359,166

(22) Filed: Jan. 26, 2012

(65) Prior Publication Data

US 2013/0194324 A1 Aug. 1, 2013

(51) Int. Cl.
*B41J 29/38* (2006.01)

(52) U.S. Cl.
USPC ..... 347/6; 347/85

(58) Field of Classification Search
USPC ..... 347/29, 30, 32, 33, 36, 85, 6, 22
See application file for complete search history.

(56) References Cited

U.S. PATENT DOCUMENTS

| | | | | |
|---|---|---|---|---|
| 4,928,120 | A * | 5/1990 | Spehrley et al. | 347/33 |
| 5,412,411 | A | 5/1995 | Anderson | |
| 5,555,461 | A | 9/1996 | Ackerman | |
| 5,898,444 | A * | 4/1999 | Kobayashi et al. | 347/29 |
| 6,616,265 | B2 | 9/2003 | Shindo et al. | |
| 7,399,055 | B2 | 7/2008 | Okamoto | |
| 7,878,635 | B2 | 2/2011 | Silverbrook | |
| 7,918,530 | B2 | 4/2011 | Kanfoush et al. | |
| 7,992,986 | B2 | 8/2011 | Snyder et al. | |
| 2005/0225599 | A1 | 10/2005 | Hudd et al. | |
| 2008/0143780 | A1 * | 6/2008 | Sakamoto et al. | 347/32 |
| 2009/0046132 | A1 * | 2/2009 | Izawa et al. | 347/85 |
| 2010/0079537 | A1 | 4/2010 | Watanabe | |
| 2010/0123755 | A1 * | 5/2010 | Korol et al. | 347/36 |
| 2010/0238227 | A1 | 9/2010 | Nystrom et al. | |
| 2010/0245494 | A1 * | 9/2010 | Inoue et al. | 347/85 |
| 2010/0271424 | A1 | 10/2010 | Cunnington et al. | |

* cited by examiner

*Primary Examiner* — Manish S Shah
*Assistant Examiner* — Yaovi Ameh
(74) *Attorney, Agent, or Firm* — Maginot, Moore & Beck, LLP

(57) ABSTRACT

A method for recirculating ink in an inkjet printer includes applying air pressure to an ink supply to expel liquid ink through a plurality of inkjets in the printhead. An ink receptacle that is positioned at a predetermined distance from the inkjets collects the expelled ink. The ink receptacle moves into fluid communication with an ink supply, and the ink collected in the ink receptacle enters the ink supply.

18 Claims, 7 Drawing Sheets

METHOD AND APPARATUS FOR INK RECIRCULATION

TECHNICAL FIELD

This disclosure relates generally to systems that supply and recover fluid from a device, and more particularly, to an inkjet printer configured to supply liquid ink to an ink reservoir within an inkjet printing apparatus and recover liquid ink from a receptacle associated with the inkjet printing apparatus.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form, either as pellets or blocks of colored ink, which are inserted into feed channels in a printer through openings to the channels. After the ink sticks are fed into the printer, they are urged by gravity or a mechanical actuator to a heater assembly of the printer. The heater assembly includes a heater and a heat transfer surface. The heater, which converts electrical energy into heat, is positioned proximate the heat transfer surface to heat the surface to a temperature that melts an ink stick coming into contact with the surface. The heat transfer surface can be oriented to drip melted ink into a reservoir and the ink stored in the reservoir continues to be heated while awaiting subsequent use.

Fluid couplings in the printer supply the liquid ink held in each reservoir of colored ink to an inkjet printing apparatus. Either a pump or the force of gravity is used to move the ink from the reservoir to a manifold in the inkjet printing apparatus. As the inkjets in the inkjet printing apparatus eject ink onto a receiving medium or imaging member, the action of the diaphragms in the inkjet ejectors pull ink from the manifold. Various embodiments of inkjets include piezoelectric and thermal devices that are selectively activated by a controller with an electrical firing signal.

Phase change ink printers often include one or more heaters that maintain a supply of phase change ink in a liquid state for use during printing operations. Some of the heaters maintain a small supply of ink in the liquid state within the reservoir and other fluid conduits within the printheads. Typically, the heaters are electrical heaters that consume electrical energy to maintain the phase change ink in a liquid phase. In order to reduce energy usage, phase change ink printers deactivate various components, including heaters, in the printer during a sleep mode to conserve energy. The ink held in the inkjet printing apparatus and inkjets cools and solidifies in some sleep modes.

While sleep modes enable a printer to operate with reduced electrical energy consumption, the solidification of phase change ink within the printer presents difficulties to printing high quality documents when the printer emerges from sleep mode. As phase change ink within the inkjet printing apparatus cools and solidifies, the ink contracts and air enters the pressure chambers and fluid conduits within the inkjet printing apparatus. As the solidified ink heats and liquefies, the air forms bubbles in the liquefied ink that can prevent inkjets in the inkjet printing apparatus from operating reliably. Additionally, liquid ink that is in the chambers within a single jet can form a meniscus across the nozzle of the inkjet whereby surface tension of the ink across the nozzle retains the ink within the pressure chamber before the inkjet ejects an ink drop. The meniscus breaks as the solid ink liquefies, resulting in some ink flowing through the nozzle, also referred to as "drooling" ink. The drooled ink can contaminate other nozzles in the printhead or separate from the printhead and produce errant marks on the image receiving member.

To eliminate air bubbles and restore the meniscus between liquefied ink and the nozzle of each inkjet, the inkjet printing apparatus undergoes a "purge" operation where pressure applied to the inkjet printing apparatus urges the liquid ink and the air bubbles through the nozzles of the inkjets. In a typical purge operation, the inkjets emit a stream of ink that flows down a face of the inkjet printing apparatus and is collected in a waste ink receptacle instead of being ejected as individual ink drops. The remaining ink on the face of the head is subsequently wiped with a silicone wiper blade. The purge operation removes air bubbles from the inkjet printing apparatus and establishes a meniscus between the liquid ink and the inkjet nozzles to enable reliable operation of the inkjets.

In existing printers, the purged ink is typically collected in a waste reservoir and is eventually discarded. In printers that enter sleep modes more often to reduce electrical energy consumption, the number of purge cycles and the corresponding amount of discarded ink increases. Thus, improvements to phase change ink printers that reduce or eliminate discarded ink produced during purge cycles are desirable.

SUMMARY

In one embodiment, a method of recirculating ink in an inkjet printer has been developed. The method includes moving a housing from a first location to a second location, which is at a predetermined distance from a plurality of inkjets in an inkjet printing apparatus. The housing includes an ink receptacle, an outlet, and an inlet. The outlet and the inlet are fluidly connected to the ink receptacle in the housing and the inlet faces the plurality of inkjets when the housing is in the second location to enable liquid ink to flow from the plurality of inkjets through the inlet to the receptacle within the housing. The method also includes applying air pressure to liquid ink in the printhead to expel the liquid ink through the plurality of inkjets substantially simultaneously, collecting the expelled liquid ink in the ink receptacle, and moving the ink receptacle to the first location to enable the outlet of the housing to be in fluid communication with an ink supply so liquid ink in the ink receptacle exits the ink receptacle through the outlet and enters the ink supply.

In another embodiment, an ink reclamation apparatus has been developed. The ink reclamation apparatus includes a housing forming an ink receptacle configured to hold a volume of ink, an inlet formed in the housing and fluidly coupled to the ink receptacle, an outlet formed in the housing and fluidly coupled to the ink receptacle, and a positioning system operatively connected to the housing. The positioning system being configured to move the housing from a first location to a second location where the inlet faces a plurality of inkjets in a printhead and the housing is located at a predetermined distance from the printhead to receive liquid ink expelled from the plurality of inkjets through the inlet to the ink receptacle, and move the housing to the first location to place the outlet in fluid communication with an ink supply to enable ink in the ink receptacle to exit the ink receptacle through the outlet and enter the ink supply.

DETAILED DESCRIPTION

Figure 1:
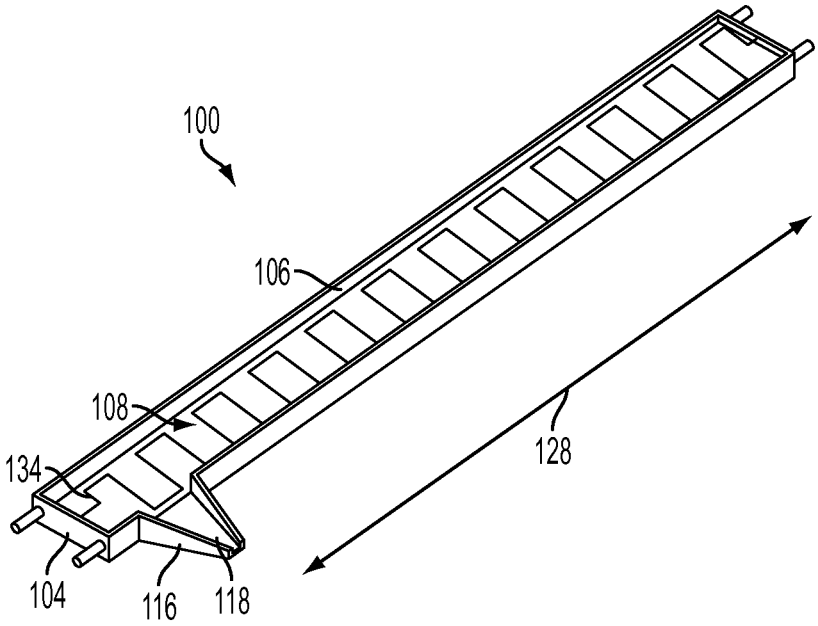
FIG. 1 is a perspective view of a housing that contains an ink receptacle that receives ink from a printhead.

For a general understanding of the environment for the system and method disclosed herein as well as the details for the system and method, reference is made to the drawings. In the drawings, like reference numerals have been used throughout to designate like elements. The term "conduit" refers to a body having a passageway or lumen through it for the transport of a liquid or a gas. As used herein, the term "face" in the context of an inkjet printing apparatus refers to an approximately planar plate of the inkjet printing apparatus that includes a plurality of apertures that form inkjet nozzles. The inkjet printing apparatus ejects ink drops through the nozzles in the face plate onto an image receiving surface during a printing operation.

As used herein, a "purge" refers to a maintenance procedure performed by an inkjet printing apparatus to forcibly expel ink from an inkjet for a purpose other than printing on a surface. A purge can be performed by applying air pressure to ink held in a manifold or other ink supply that is fluidly coupled to the inkjets or by applying suction to the inkjet nozzles. A purge is typically used to remove air bubbles from conduits within the inkjet printing apparatus that form each time phase change ink is melted from solid to liquid. A purge may also be used to clear contaminants from inkjet ejectors. Prior-art purge operations emit ink through the inkjets and the emitted ink flows down the face of the printhead. The purge operations described in this document, however, expel ink through the inkjets so that a substantial volume of the expelled ink does not remain in contact with the printhead face. As used herein, "expelling" ink during a purge operation refers to applying pressure to a liquid ink reservoir that moves ink through a plurality of inkjet nozzles in the printhead face with sufficient force so that the substantial volume of the ink leaves the printhead face and moves along a ballistic trajectory. The term "purged ink" refers to ink expelled during the purge operations described herein.

An operation that expels ink from a printhead is distinct from an operation that ejects ink from the printhead. As used herein, "ejecting" ink refers to operation of an actuator in an inkjet in a printhead to force a small volume of ink through a corresponding nozzle in the form of an ink drop that moves along a ballistic trajectory. Typical examples of inkjet actuators include, but are not limited to, thermal actuators and piezoelectric actuators. A thermal actuator heats ink in a small pressure chamber to generate a vapor bubble that expands and forces ink in the pressure chamber through a corresponding nozzle in the form of an ink drop. A piezoelectric actuator generates a mechanical force that expels ink from a pressure chamber through the corresponding nozzle in the form of an ink drop. In either embodiment, an electronic control device generates an electrical signal, also referred to as a firing signal, to operate actuators in a plurality of inkjets at predetermined times. The pattern of ejected ink drops forms an ink image on an image receiving surface. Each inkjet ejects an ink drop only in response to operation of the actuator in the corresponding inkjet. An inkjet ejects a single drop of ink during a typical ejection operation. In contrast, an external pressure expels a volume of ink that is typically larger than the volume of a single ink drop through the inkjet during a purge operation without the activation of the actuator in the inkjet. Additionally, a single purge operation expels ink through a plurality of inkjets substantially simultaneously when the plurality of inkjets are each fluidly coupled to a single ink supply.

As used herein, the terms "solid ink" and "phase change ink" both refer to inks that are substantially solid at room temperature and substantially liquid when heated to a phase change ink melting temperature. The ink is liquefied for jetting onto an imaging receiving surface. The phase change ink melting temperature can be any temperature that is capable of melting solid phase change ink into liquid or molten form.

Figure 6A:
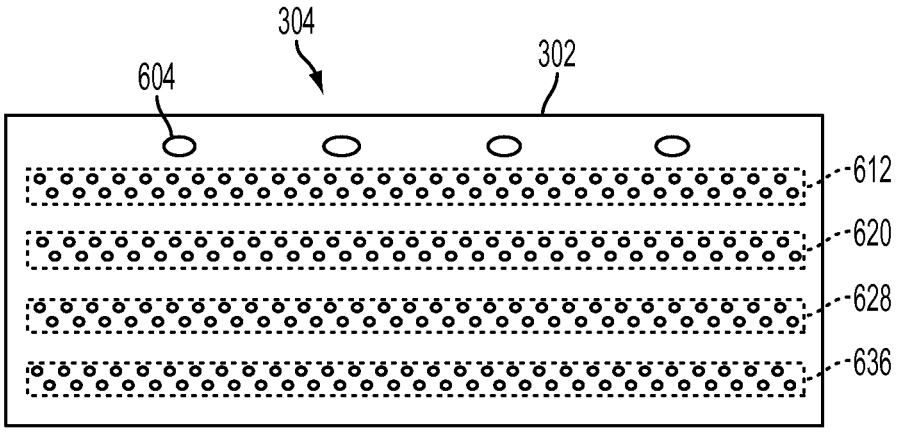
FIG. 6A PRIOR ART
FIG. 6A is a prior art depiction of a face of a multicolor printhead.

As used herein, the term "face" in the context of a printhead refers to an approximately planar region of a printhead that includes a plurality of inkjet nozzles. The printhead ejects ink drops through the apertures in a face plate, that are sometimes called "nozzles," of the printhead onto an image receiving surface during a printing operation. During a purge operation, ink flows through the nozzles and onto the face of the printhead. FIG. 6A depicts a prior art configuration of a face 302 in a multicolor printhead 304, that is configured to print cyan, magenta, yellow, and black (CMYK) inks. In the multicolor printhead 304, multiple groups of inkjet nozzles are arranged in the face 302. Inkjet groups 612, 620, 628, and 636 eject black, yellow, magenta, and cyan inks, respectively. Each of the inkjet groups includes two rows of inkjet nozzles, but alternative printhead configurations include inkjet nozzles that are grouped in different configurations. Additionally, single color printheads include a printhead face with an arrangement of inkjet nozzles that eject a single color of ink, and alternative multicolor printheads eject different colors of ink than the CMYK configuration of printhead 304. The printhead face 302 also includes a series of vents 604. During a purge operation, the vents are used to clear bubbles that are formed in the ink as well as other purposes such as fluidic damping of the ink. The air pressure applied to ink in the ink supplies may expel some ink through one or more of the vents 604 in a similar manner to expelling ink through the inkjet groups 612-636.

FIG. 1 depicts an ink recirculation container 100 including a single ink receptacle that receives purged ink from a printhead, holds the purged ink within the ink receptacle, and empties the purged ink into an ink supply. The ink recirculation container 100 collects ink purged in inkjet printers, including inkjet printers that form ink images using liquid drops of phase change ink, to hold the purged ink and return the purged ink to an ink supply in the printer. The recirculation container 100 includes a housing 104 that forms an ink receptacle 108 and an outlet 116. An inlet 106 formed in the housing places the ink receptacle 108 in fluid communication with a plurality of inkjets to enable ink expelled from one or more printheads to enter the ink receptacle 108. In the embodiment of FIG. 1, the housing 104 and ink receptacle 108 each have a width 128 that corresponds to the width of a face of one printhead. In an alternative embodiment, the housing 104 and ink receptacle 108 each have a width corresponding to two or more printheads that are arranged in a printhead array.

In the housing 104, the outlet 116 is fluidly coupled to the ink receptacle 108. Expelled phase change ink enters the ink receptacle 108 and moves toward the outlet 116 under the force of gravity. The outlet 116 is formed in a funnel shape that directs the ink to an outlet opening 118. During a purge operation, the housing 104 and outlet 116 are positioned at a predetermined distance from the face of a printhead that expels purged ink. In one embodiment, the inlet 106 in the housing 104 is positioned at a distance of approximately one centimeter from the face of the printhead. The printhead heats to a temperature that melts the phase change ink prior to expelling the ink. The housing 104 and outlet 116 remain thermally isolated from the printhead and other heated components in an inkjet printer. Upon entering the ink receptacle 108, the liquid phase change ink cools and solidifies in the ink receptacle. Some liquid ink that flows toward the outlet 116 cools and solidifies within the funnel shaped projection of the outlet 116 prior to exiting through the outlet opening 118. The projection of the outlet 116 forms a comparatively large surface area around ink in the outlet 116 to enable heat from the ink to radiate from the housing 104 and enable the ink to solidify within the outlet 116. In a printing apparatus that employs a liquid ink, such as an aqueous or solvent based ink, the outlet 116 includes a valve that selectively closes to hold ink in the ink receptacle 108, and opens to enable the ink to flow from the ink receptacle 108 through the outlet 116.

The ink recirculation container 100 includes an optional heater 134 that is positioned within the housing 104 and that extends along the width of the ink receptacle 108. In the embodiment of FIG. 1, the heater 134 is an electrical resistive heater formed from nichrome wire or another resistive heating element. The heater 134 activates when the ink recirculation container 100 and outlet 116 move into fluid communication with an ink supply. The heater 134 melts the solidified phase change ink in the ink receptacle 108 and the ink outlet 116. The liquid ink flows out of the ink receptacle 108 through the outlet 116 and opening 118, and subsequently enters an ink supply. Alternative embodiments of the ink recirculation container 100 omit the heater 134. In embodiments that omit the heater, another heat source in the inkjet printer applies heat to the ink recirculation container 100 to melt the ink when the outlet 116 is in fluid communication with an ink supply.

The ink recirculation container 100 is configured for use with both single color and multicolor printheads. A single color printhead ejects one color of ink, such as one of a cyan, magenta, yellow, or black ink in a CMYK color printer. In one configuration, the ink recirculation container 100 collects ink from only one printhead and returns the collected ink to an ink supply that supplies the printhead. In another configuration, the ink recirculation container 100 collects ink from each printhead in a plurality of single color printheads. The inks from each printhead mix in the ink receptacle 108 and the mixed inks are recirculated into a black ink supply for ejection by a black ink printhead. In a multicolor printhead configuration, groups of inkjets formed in the printhead are fluidly coupled to ink supplies that each hold a different color of ink. During a purge operation, the multicolor printhead purges ink of two or more colors into the ink receptacle 108. The ink recirculation container holds the combined ink in the ink receptacle until the ink is recirculated into a black ink supply.

Figure 2:
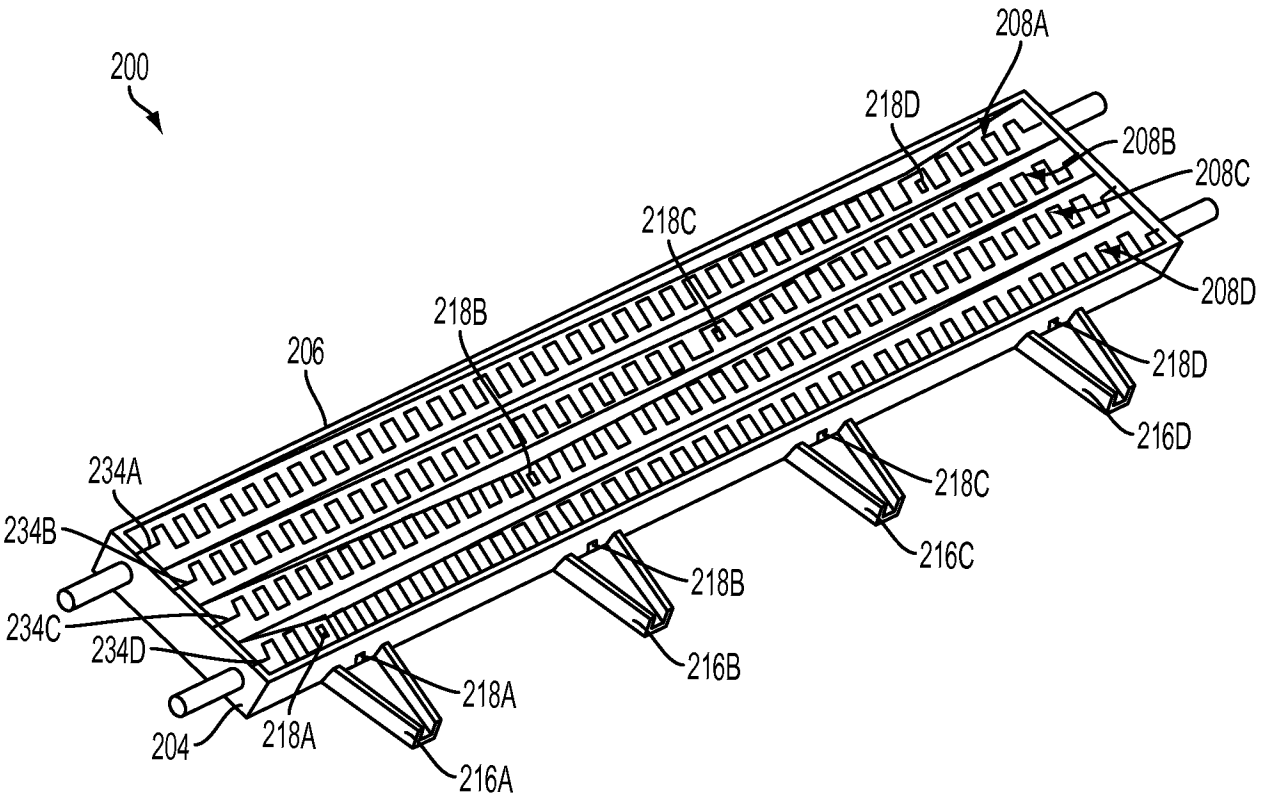
FIG. 2 is a perspective view of a housing that contains a plurality of ink receptacles that each receive one color of ink from a printhead.

FIG. 2 depicts an ink recirculation container 200 that includes a plurality of ink receptacles with each ink receptacle being configured to hold one color of ink. The ink recirculation container 200 includes a housing 204 that forms ink receptacles 208A, 208B, 208C, and 208D. Each of the ink receptacles 208A-208D is fluidly coupled to only one of fluid conduits 218A-218D, and the fluid conduits 218A-218D place the corresponding ink receptacles 208A-208D in fluid communication with only one of a plurality of outlets 216A-216D. An inlet 206 formed in the housing 204 places each of the ink receptacles 208A-208D in fluid communication with a plurality of inkjets to enable expelled ink from a group of inkjets to enter a corresponding one of the ink receptacles 208A-208D. The ink receptacles 208A-208D are fluidly isolated from each other in the housing 204 to prevent different colors of ink from mixing. The ink receptacles 208A-208D include heaters 234A-234D, respectively, that are configured to generate heat to melt solidified ink when the ink recirculation container 200 is in fluid communication with ink supplies in the printer. One embodiment of the housing 204 includes a first aluminum housing member that forms the ink receptacles 208A-208D engaged to a second aluminum housing member that forms the outlets 216A-216D and fluid conduits 218A-218D. The ink recirculation container 200 includes the four ink receptacles 208A-208D for printers that employ four colors of ink, such as CMYK printers. Alternative embodiments of the ink recirculation container 200 include a number of receptacles and outlets that correspond to a number of different colors of ink printed from printheads in the printer.

During a purge operation, the recirculation container 200 moves to a predetermined distance from the printhead to place at least one of the ink receptacles 208A-208D into fluid communication with the face of the printhead. In one embodiment, a positioning system moves the housing 204 into fluid communication with one group of inkjets that expel ink into one of the ink receptacles 208A-208D, the positioning system moves the housing 204 to a plurality of locations and the printhead expels a different color of ink into each ink receptacle. In another embodiment, the positioning system moves the housing 204 into a location where each group of inkjets in the printhead is in fluid communication with a corresponding one of the ink receptacles. The printhead can expel ink from all of the inkjet groups simultaneously, or progressively expel ink from each group of inkjets into the ink receptacles 208A-208D. The housing 204 is located at a predetermined distance from the printhead and remains thermally isolated from the heater in the printhead to enable phase change ink to solidify within each of the ink receptacles 208A-208D.

Figure 3:
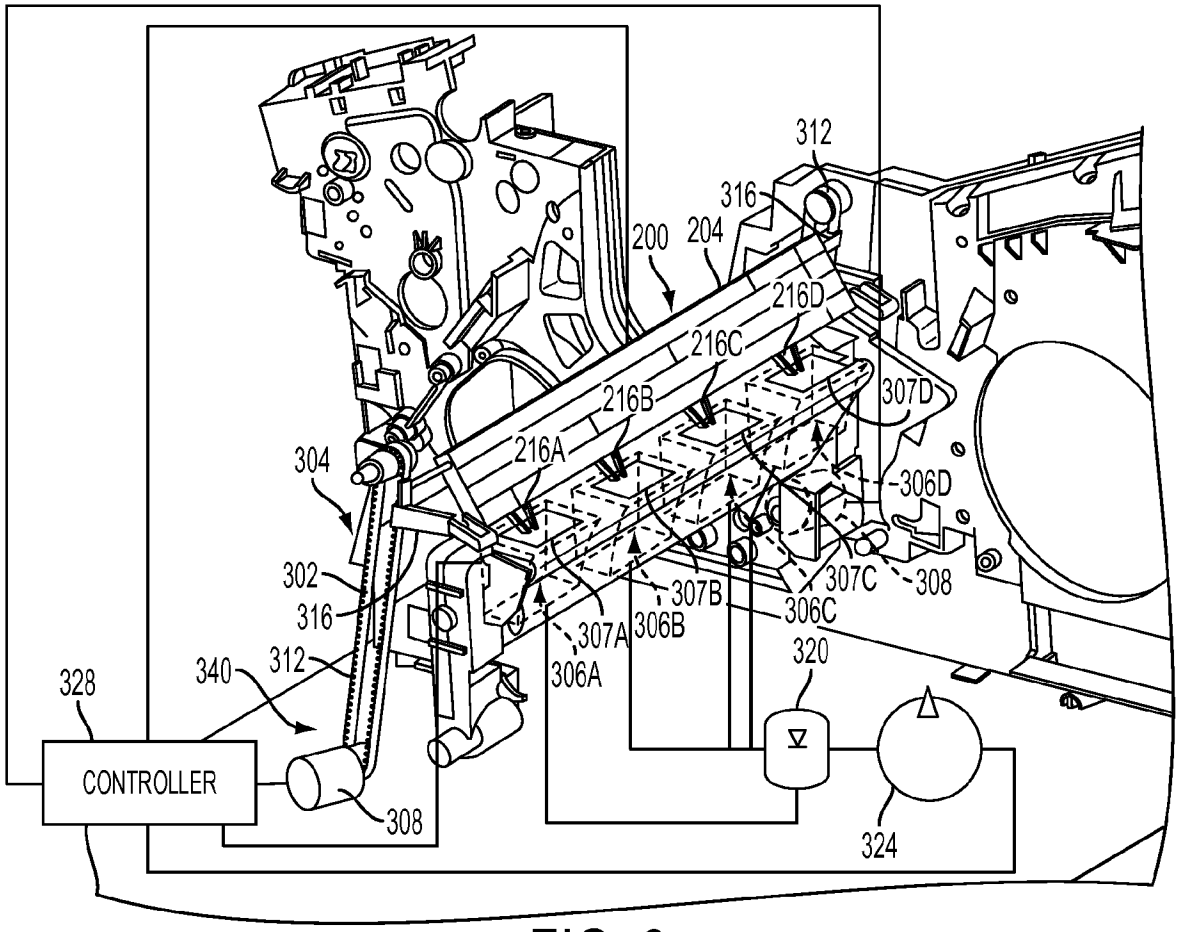
FIG. 3 is a perspective view of the housing and ink receptacle of FIG. 2 located above an ink supply of a printhead in an inkjet printer.

In operation within an inkjet printer, a positioning system moves either one of the ink recirculation containers 100 and 200 between at least two locations to collect purged ink within the containers and to return the purged ink to one or more ink supplies. FIG. 3 depicts a positioning system 340 in an inkjet printer that moves the ink recirculation container 200 into engagement with the face 302 of printhead 304 and into fluid communication with an ink supplies 306A-306D. In the example of FIG. 3, the printhead 304 is a multicolor printhead and ink supplies 306A-306D correspond to black, yellow, magenta, and cyan ink supplies, respectively. The positioning system 340 includes actuators 308 that drive a pair of toothed belts 312. The toothed belts 312 engage either end of the ink recirculation container 200 along the width of the housing 204. Retention clips 316 engage each end of the ink receptacle 200 that correspond to one of the toothed belts 312, and the ink receptacle 200 moves as indicated by arrows 332 and 334 in response to the actuators 308 rotating the toothed belts 312.

In FIG. 3, a controller 328 is operatively connected to the actuators 308 in the positioning system 340 and to the heaters 234A-234D in the ink recirculation container 200. The controller 328 is a digital controller such as a microcontroller, microprocessor, field programmable gate array (FPGA), application specific integrated circuit (ASIC) or the like. In some embodiments, the controller 328 is a central control unit that controls the operation of other components and subsystems in an inkjet printer. During a purge operation, the controller 328 selectively activates the actuators 308 to position the ink recirculation container 200 at one or more predetermined locations that place at least one of the ink receptacles 208A-208D in fluid communication with inkjets and vents in the face 302 of the printhead 304. As described in more detail below, the repositioning system 340 moves the ink recirculation container to different locations proximate to the face 302 of the printhead 304 to place each of the ink receptacles 208A-208D in a position that collects expelled ink from a corresponding group of inkjets in the printhead 304.

The controller 328 is operatively connected to an air pump 324 and optional pressure accumulator 320. During a purge operation, the air pump 324 generates air pressure that is applied to an air pocket formed over liquefied ink in at least one of the ink supplies 306A-306D. The air pressure is applied for a predetermined time at a predetermined pressure level to urge ink in the pressurized ink supply through fluid conduits in the printhead and to expel the pressurized ink through the inkjets that are fluidly coupled to the pressurized ink supply. In the printhead 304, pressurized air is applied to the ink supplies 306A, 306B, 306C, and 306D to expel ink through the corresponding inkjet groups 612, 620, 628, and 636, respectively. The air pump 324 and air accumulator 320 generate an increased air pressure of between approximately 3 pounds per square inch (PSI) to 30 PSI with a duration of approximately 0.025 seconds to 1 second to expel ink from each group of inkjets in the printhead 304. The pressure level and duration are selected with reference to the number and diameter of the inkjet nozzles in the printhead and to the volume of ink that is expelled during the purge operation.

In the embodiment of FIG. 3, the air pump 324 applies pressure to the pressure accumulator 320 and one of a plurality of outlet valves in the pressure accumulator 320 opens to supply pressurized air to one of the ink supplies 306A-306D in response to the internal pressure in the pressure accumulator 320 exceeding a predetermined threshold. In another embodiment, the air pump 324 applies pressure directly to one or more of the ink supplies 306A-306D. Air pump 324 and pressure accumulator 320 are depicted schematically in FIG. 3. Some printhead embodiments include an air pump and accumulator that are integrated with ink supplies, such as ink supplies 306A-306D, while other embodiments include air pumps and accumulators that are external to the ink supply.

In the configuration of FIG. 3, the controller 328 activates the positioning system 340 to move the ink recirculation container 200 into fluid communication with an ink supply 306A after the printhead 304 has purged ink into one or more of the ink receptacles 208A-208D. The controller 328 activates an electrical current through the heaters 234A-234D in the ink recirculation container 200, and the heat from the heaters liquefies the solidified ink. The liquefied ink exits the ink recirculation container 200 through the outlets 216A-216D. The outlets 216A-216D are positioned above corresponding ink supplies 306A-306D and liquefied ink from each of the ink receptacles 208A-208D enters one of ink supplies 306A-306D, respectively. Each of the ink supplies 306A-306D can include one of retractable members 307A-307D, respectively, that opens to enable ink from the recirculation container 200 to enter the ink supplies. The printhead 304 uses the recirculated ink in subsequent printing operations. Thus, the purged ink is not discarded after a purge operation and the ink recirculation container 200 enables efficient use of ink in an inkjet printer.

Figure 4:
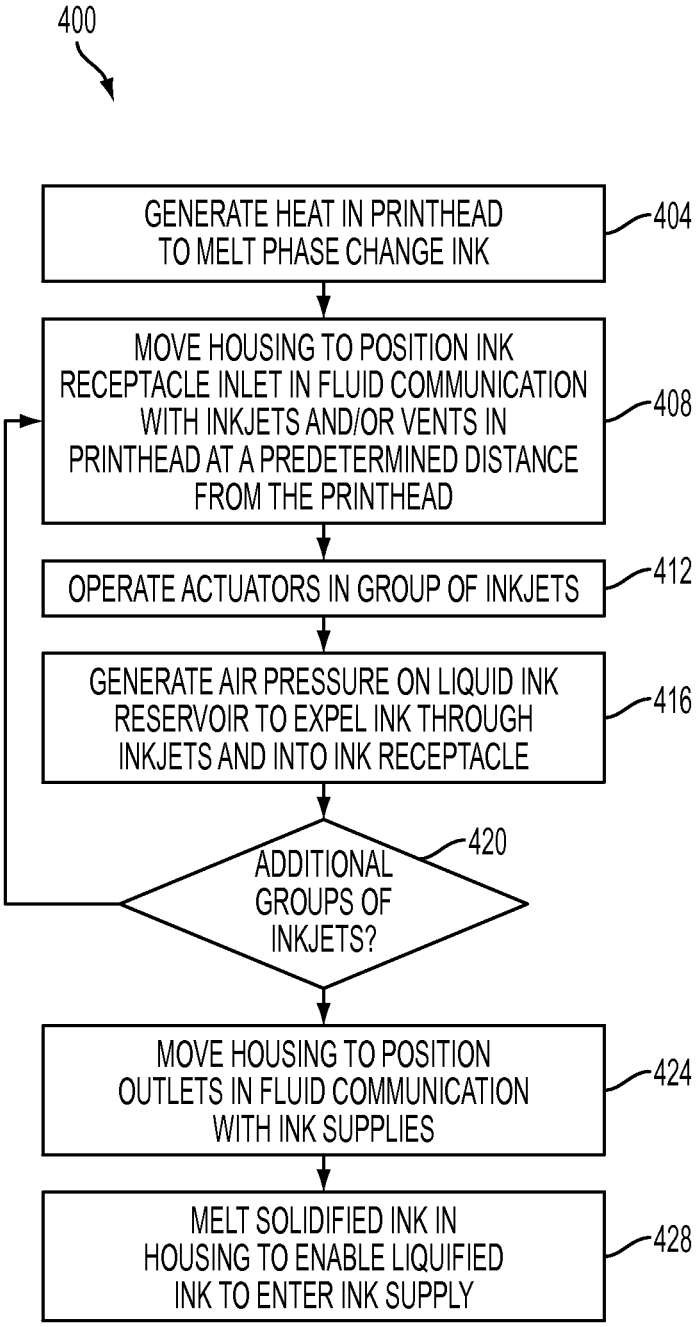
FIG. 4 is a block diagram of a process for expelling ink from a printhead and for recirculating the expelled ink into an ink supply.

FIG. 4 depicts a process 400 for expelling ink from a printhead and recirculating the expelled ink to an ink supply for later use by the printhead. Process 400 is described with reference to the ink recirculation container 200 and multicolor printhead 304 for illustrative purposes. In the discussion below, a reference to the process performing a function or action refers to a controller executing programmed instructions stored in a memory to operate one or more components of the printer to perform the function or action. In one configuration, a "cold" printer performs process 400. Various heaters in a cold printer have been deactivated for a sufficiently long period of time to enable phase change ink in the printheads and inkjets of the printer to solidify. Process 400 begins by activating one or more heaters in the printhead, and optionally in other components of the printer, to melt the solidified phase change ink (block 404).

Figure 5B:
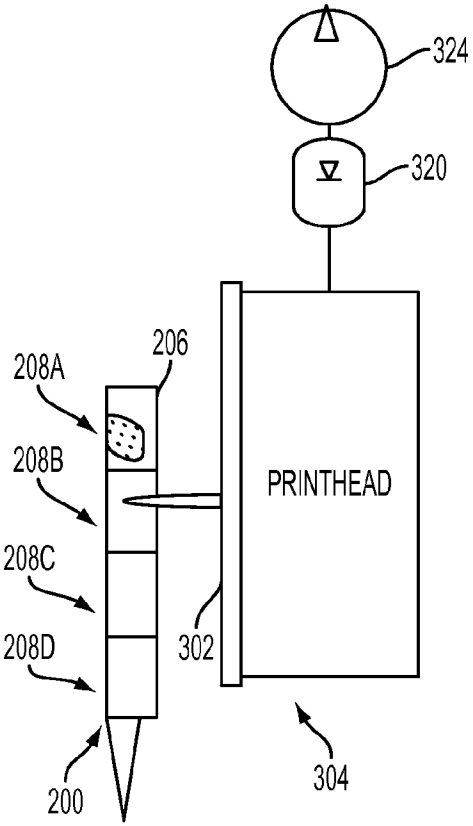
FIG. 5B is a schematic view of the housing of FIG. 2 engaging the printhead of FIG. 3 to receive a second ink from the printhead in a second ink receptacle in the housing.
Figure 5A:
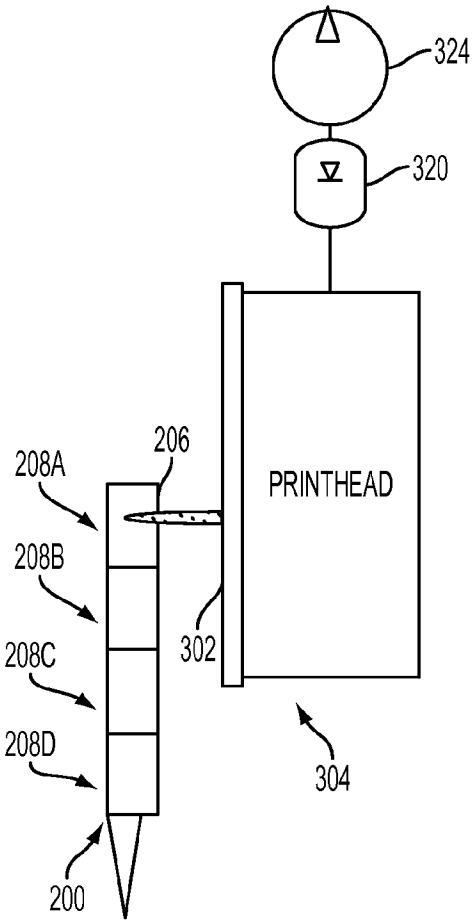
FIG. 5A is a schematic view of the housing of FIG. 2 engaging the printhead of FIG. 3 to receive a first ink from the printhead in a first ink receptacle in the housing.
Figure 5D:
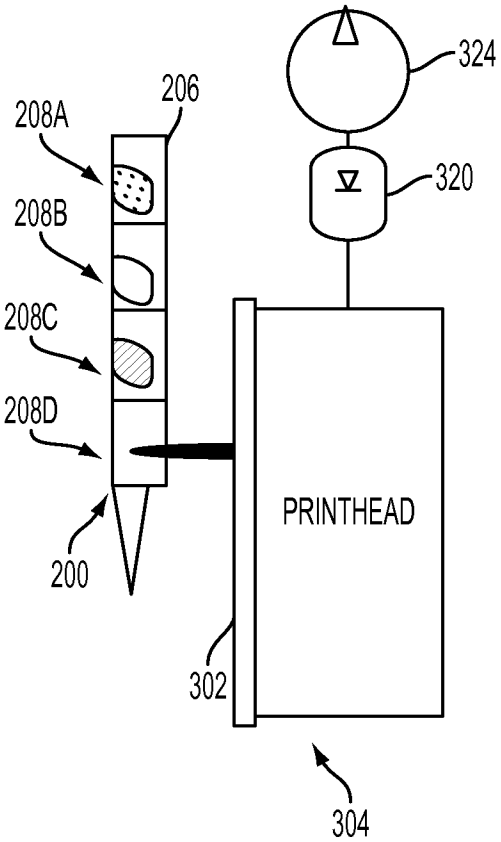
FIG. 5D is a schematic view of the housing of FIG. 2 engaging the printhead of FIG. 3 to receive a fourth ink from the printhead in a fourth ink receptacle in the housing.
Figure 5C:
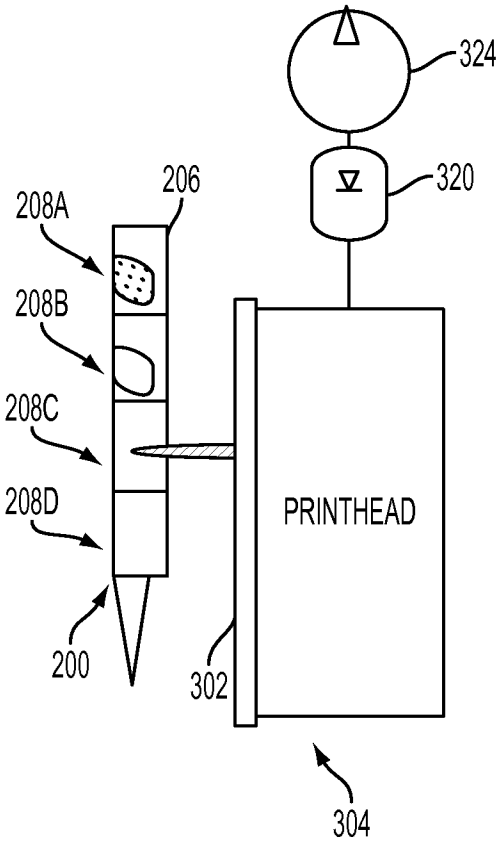
FIG. 5C is a schematic view of the housing of FIG. 2 engaging the printhead of FIG. 3 to receive a third ink from the printhead in a third ink receptacle in the housing.

During a purge process, the ink reclamation container 200 moves into a position at a predetermined distance from the face of the printhead to receive ink that is expelled from the printhead (block 408). The controller 328 activates the actuators 308 in the positioning system 340 to move the ink reclamation container from the first location depicted in FIG. 3 to one or more secondary locations that position the ink receptacles 208A-208D in fluid communication with corresponding groups of inkjets in the printhead face 302. For example, FIG. 5A-FIG. 5D depict the ink recirculation container 200 in four locations relative to the printhead face 302. In FIG. 5A, the ink receptacle 208A is positioned in fluid communication with the cyan inkjet group 636 at a distance of approximately one centimeter from the printhead face 302. Cyan ink that is expelled through the inkjets 636 moves through the inlet 206 and into the ink receptacle 208A. Similarly, FIG. 5B depicts the ink receptacle 208B positioned in fluid communication with the magenta inkjet group 628, FIG. 5C depicts the ink receptacle 208C positioned in fluid communication with the yellow inkjet group 620, and FIG. 5D depicts the ink receptacle 208D positioned in fluid communication with the black inkjet group 612.

Figure 6B:
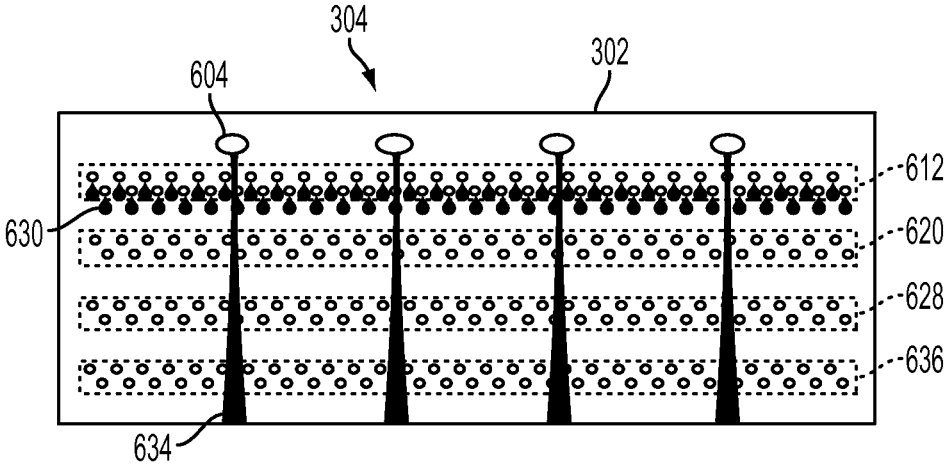
FIG. 6B PRIOR ART
FIG. 6B is a prior art depiction of the face of the multicolor printhead of FIG. 6A with ink formed on the face.

Process 400 optionally operates the actuators in a group of inkjets after the ink receptacle in the ink recirculation container is located in fluid communication with the group of inkjets (block 412). In the printhead 304, the controller 328 generates firing signals to activate the inkjets in one of the inkjet groups 612-636 in the printhead 304. The operation of the inkjets clears small amounts of ink in the pressure chambers of the inkjets that may leak from the inkjets during process 400 prior to sufficient pressure being applied to the ink supply to expel ink away from the face of the printhead. FIG. 6B depicts an example of leaked ink, also referred to as "drooled" ink, on the printhead face 302 from the black jets or the black vents in the top row. FIG. 6B shows a small volume of black ink 630 leaking from the black inkjet group 612. In a multicolor printhead there are typically vents for each color and the drooled ink can leak through either or both of the vents and the inkjet nozzles. Therefore, the pressure applied to the black ink supply 306A may generate leakage of black ink 634 through the vents 604. After completion of the purge operation, the leaked ink is wiped from the printhead face 302 using a wiping technique that is known to the art. Process 400 minimizes the volume of ink that leaks through the inkjets by activating the inkjets to eject ink drops into the ink recirculation container 200. The volume of leaked ink is minimal in comparison to the volume of ink that is expelled through the inkjets and the vents in the printhead 304 and subsequently recirculated into the ink supplies 306A-306D. In some embodiments, multiple colors of leaked ink are combined and recirculated into the black ink supply.

Once the ink recirculation container is in the predetermined location, process 400 generates air pressure to expel ink through the group of inkjets that are in fluid communication with the ink recirculation container (block 416). In the embodiment of the printhead 304, the controller 328 activates the air pump 324 and pressure accumulator 320 to build air pressure and apply the air pressure to a selected one of the ink supplies 306A-306D. The pressure expels ink through a corresponding group of inkjets. As depicted in FIG. 5A-FIG. 5D, each of the ink receptacles 208A-208D has sufficient volume to hold the expelled ink and to prevent the expelled ink from splashing, leaking, or otherwise contaminating other components in the printer.

The outer dimensions of the ink receptacles 208A-208D are determined by the arrangement of inkjet nozzles and the amount of ink that is expelled from the printhead. The height of each of the ink receptacles 208A-208D is sufficiently large to account for the height of each group of inkjets that expels ink into the container 200, such as inkjet groups 612-636. The depth and height of each ink receptacle form a volume that is sufficiently large to hold the ink expelled by the printhead. In some embodiments, the depth and height for each of the ink receptacles 208A-208D are between approximately 0.1 cm and 1 cm. For a page-wide printhead or array of multiple printheads that are configured to print images onto A/A4 sized media, the ink receptacles 208A-208D form a volume of approximately 0.22 $cm^3$ to 22 $cm^3$. Similarly, the single ink receptacle in the recirculation container 100 has a volume that is sufficient to hold the ink expelled from the printhead. In a four-color printhead embodiment, the single receptacle 108 in the recirculation container 100 has a volume in a range of approximately 0.88 $cm^3$ to 88 $cm^3$ to accommodate the four colors of purged ink.

The purge operation expels a mass of ink ranging from approximately 0.1 grams to 15 grams from each group of inkjets, and the ink receptacles 208A-208D capture and solidify the expelled ink. The inlet 206 formed in the housing 204 presents a sufficiently large aperture to enable all of the ink expelled from each of the groups of inkjets to enter only one of the ink receptacles 208A-208D. The expelled ink cools and solidifies within the ink recirculation container 200. In the embodiment of printhead 304, the vents 604 may expel black ink in response to the air pressure applied to the black ink supply 306A. The black ink receptacle 208D collects the black ink that is expelled from both the black inkjet group 612 and the vents 604.

As depicted in FIG. 5A-FIG. 5D, some printhead embodiments include multiple groups of inkjets. Process 400 purges ink from each group of inkjets into the ink recirculation container (block 420) according to the process described above in blocks 408-416. Once the ink recirculation container has received purged ink from each group of inkjets, process 400 moves the housing of the ink recirculation container into a location that places the outlets of the ink recirculation container in fluid communication with the ink supplies (block 424). As depicted in FIG. 3, the controller 328 operates the actuators 308 to move the ink recirculation container 200 into fluid communication with the ink supplies 306A-306D. The outlets 216A-216D are each positioned over one of the ink supplies 306A-306D, respectively, and the controller 328 opens the retractable members 307A-307D to place the ink receptacles 208A-208D in fluid communication with the ink supplies 306A-306D, respectively. The controller 328 subsequently activates the heaters 234A-234D in the ink recirculation container 200 to melt the ink and enable the melted ink to flow from the ink recirculation container 200 into the ink supplies 306A-306D under the force of gravity (block 428).

Process 400 is performed to collect and recirculate ink from single color and multicolor printheads. In a printer embodiment that includes the ink recirculation container 100, process 400 recirculates a single color of ink from a single color printhead, or combines multiple colors of ink in the ink receptacle 108 and then recirculates the combined ink into a black ink supply for use in printing operations.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

We claim:

1. A method of operating an inkjet printer comprising:

moving a housing from a first location to a second location, which is at a predetermined distance from a plurality of inkjets in an inkjet printing apparatus, the housing including a first ink receptacle, an outlet, and an inlet, the outlet and the inlet being fluidly connected to the first ink receptacle in the housing and the inlet facing the plurality of inkjets when the housing is in the second location to enable liquid ink to flow from the plurality of inkjets through the inlet to the first receptacle within the housing;

applying air pressure to liquid ink in the printhead to expel the liquid ink through the plurality of inkjets substantially simultaneously;

collecting the expelled liquid ink in the first ink receptacle;

moving the first ink receptacle to the first location to enable the outlet of the housing to be in fluid communication with an ink supply so liquid ink in the first ink receptacle exits the first ink receptacle through the outlet and enters the ink supply;

moving the housing to a third location to place a second inlet in the housing at the predetermined distance from a second plurality of inkjets in the inkjet printing apparatus, the second inlet being fluidly connected to a second ink receptacle in the housing;

applying the air pressure to a second liquid ink in the printhead to expel the second liquid ink through the second plurality of inkjets substantially simultaneously;

collecting the expelled second liquid ink in the second ink receptacle; and moving the housing to the first location to place an outlet fluidly connected to the second ink receptacle in fluid communication with a second ink supply to enable the second liquid ink in the second ink receptacle to exit the second ink receptacle through the outlet and enter the second ink supply.

2. The method of claim 1 further comprising:

enabling a temperature of the first ink receptacle to reach a freezing temperature of the liquid ink collected in the first ink receptacle to enable the liquid ink to solidify in the first ink receptacle.

3. The method of claim 1 further comprising:

heating solidified ink the in the first ink receptacle in response to the outlet in the first ink receptacle being in fluid communication with the ink supply to liquefy the solidified ink and enable the liquefied ink to exit the first ink receptacle through the outlet.

4. The method of claim 1, the air pressure being applied with a level of between approximately 10 pounds per square inch (PSI) and 25 PSI.

5. The method of claim 4, the air pressure being applied for a time period of approximately 0.05 seconds and 0.5 seconds.

6. The method of claim 1, the inkjet printing apparatus expelling between approximately 0.2 gram and 10 grams of the liquid ink.

7. The method of claim 1, wherein the inlet in the housing faces at least one vent in the inkjet printing apparatus and the plurality of inkjets in the inkjet printing apparatus when the housing is in the second location, and wherein the applying of air pressure to the liquid ink expels the liquid ink through the at least one vent for collection by the first ink receptacle.

8. The method of claim 1 further comprising:

operating an actuator in each of the plurality of inkjets in the inkjet printing apparatus at a time after moving the first ink receptacle to the second location and prior to applying the air pressure to the liquid ink in the inkjet printing apparatus.

9. The method of claim 1 further comprising:

enabling a temperature of the second ink receptacle to reach a freezing temperature of the second liquid ink collected in the second ink receptacle to enable the second liquid ink to solidify in the second ink receptacle.

10. The method of claim 1 further comprising:

heating solidified second ink the in the second ink receptacle in response to the outlet in the second ink receptacle being in fluid communication with the second ink supply to liquefy the solidified second ink and enable the liquefied second ink to exit the second ink receptacle through the outlet in the second ink receptacle.

11. A printing apparatus comprising:

a housing forming a first ink receptacle configured to hold a volume of ink;

an inlet formed in the housing and fluidly coupled to the first ink receptacle;

an outlet formed in the housing and fluidly coupled to the first ink receptacle;

a second ink receptacle formed in the housing;

a second inlet formed in the housing that is fluidly coupled to the second ink receptacle;

a second outlet formed in the housing that is fluidly coupled to the second ink receptacle; and a positioning system operatively connected to the housing and configured to:

move the housing from a first location to a second location where the inlet faces a plurality of inkjets in a printhead and the housing is located at a predetermined distance from the printhead to receive liquid ink expelled from the plurality of inkjets through the inlet to the first ink receptacle;

move the housing to the first location to place the outlet in fluid communication with an ink supply to enable ink in the first ink receptacle to exit the ink receptacle through the outlet and enter the ink supply;

move the housing to a third location where the second inlet faces a second plurality of inkjets in the printhead and the housing is located at the predetermined distance from the inkjet printing apparatus to receive a second liquid ink expelled from the second plurality of inkjets in the second ink receptacle; and move the housing to the first location to place the second outlet in fluid communication with a second ink supply to enable ink in the second ink receptacle to exit the second ink receptacle and enter the second ink supply.

12. The apparatus of claim 11 further comprising:

a heater operatively connected to the housing; and a controller operatively connected to the heater, the controller being configured to operate the heater selectively to maintain a temperature in the first receptacle that is below a freezing temperature of the liquid ink to enable the liquid ink to solidify in the first ink receptacle.

13. The apparatus of claim 12, the controller being further configured to activate the heater in response to the outlet being in fluid communication with the ink supply to melt the solid ink in the first ink receptacle and enable the melted ink to exit the first ink receptacle through the outlet and enter the ink supply.

14. The apparatus of claim 11 wherein the first ink receptacle is configured to hold at least two colors of liquid ink expelled from the plurality of inkjets; and the positioning system is configured to move the housing to the first location to place the outlet in fluid communication with a black ink supply to enable the at least two colors of ink in the first ink receptacle to exit the first ink receptacle through the outlet and enter the black ink supply.

15. The apparatus of claim 11 wherein the inlet is configured to face the plurality of inkjets in the printhead and at least one vent in the printhead when the housing is moved to the second location to receive liquid ink expelled from the plurality of inkjets and to receive liquid ink expelled from the at least one vent.

16. The apparatus of claim 11 further comprising:

a heater operatively connected to the housing; and a controller operatively connected to the heater, the controller being configured to operate the heater selectively to maintain a temperature in the receptacle that is below a freezing temperature of the liquid ink to enable the liquid ink in the receptacle to solidify in the receptacle.

17. The apparatus of claim 11 further comprising:

a second heater operatively connected to the second receptacle to generate heat and melt solidified ink in the second ink receptacle; and the controller being operatively connected to the second heater and further configured to:

activate the second heater in response to the second outlet being positioned at the first position where the second outlet is in fluid communication with the second ink supply to melt the solidified ink in the second ink receptacle and enable the melted ink to exit the second receptacle through the second outlet and enter the second ink supply.

18. The apparatus of claim 11 wherein the ink receptacle is configured to hold between approximately 0.2 grams and 10 grams of the liquid ink.

* * * * *